US006390435B1

(12) United States Patent
Gustafsson

(10) Patent No.: US 6,390,435 B1
(45) Date of Patent: May 21, 2002

(54) MAST BASE

(75) Inventor: Karl Martin Gustafsson, Skellefteå(SE)

(73) Assignee: Cue Dee Produkter AB, Robertsfors (SE)

( * ) Notice: Subject to any disclaimer, the term of this patent is extended or adjusted under 35 U.S.C. 154(b) by 0 days.

(21) Appl. No.: 09/529,233

(22) PCT Filed: Oct. 7, 1998

(86) PCT No.: PCT/SE98/01807

§ 371 Date: Apr. 10, 2000

§ 102(e) Date: Apr. 10, 2000

(87) PCT Pub. No.: WO99/18309

PCT Pub. Date: Apr. 15, 1999

(30) Foreign Application Priority Data

Oct. 8, 1997 (SE) ..... 9703660

(51) Int. Cl.[7] ..... F16M 13/00

(52) U.S. Cl. ..... 248/519; 343/882

(58) Field of Search ..... 248/519, 523, 248/678, 346.01, 188.8, 188.7, 188.1, 188.5; 52/146, 148; 343/881, 880, 882

(56) References Cited

U.S. PATENT DOCUMENTS 3,028,595 A * 4/1962 Cole et al. ..... 343/882
4,146,897 A * 3/1979 Wilson et al. ..... 343/882
4,799,642 A * 1/1989 Wright ..... 248/516
5,363,116 A 11/1994 Allen ..... 343/881
5,531,419 A 7/1996 Gustafsson ..... 248/519
5,576,722 A * 11/1996 Bustillos ..... 343/882

FOREIGN PATENT DOCUMENTS

SE 428 948 8/1983
WO 93/17208 9/1993

* cited by examiner

*Primary Examiner*—Leslie A. Braun
*Assistant Examiner*—Gwendolyn Baxter
(74) *Attorney, Agent, or Firm*—Browdy and Neimark, P.L.L.C.

(57) ABSTRACT

A mast base comprises a rigid body (10) and four supporting legs (15), extending laterally from the body (10) in mutually diverging directions. Each supporting leg (15) comprises an upper arm (17) and a lower arm (18). At its inner end, each arm (17, 18) is pivotally connected to the body (10) for pivoting movement relatively to the body around an appurtenant horizontal pivot axis ($x_1$, $x_2$). At their outer ends, the two arms (17, 18) are pivotally connected to each other. At least one arm (18) has a variable length. The upper arm (17) of each one of two supporting legs (15), which are located at mutually opposite sides of the body (10) and extend in mutually opposite directions therefrom, is pivotally connected to the body (10) by means to two separate pivot joints (19), which are located at a substantial horizontal distance from each other.

7 Claims, 3 Drawing Sheets

MAST BASE

CROSS REFERENCE TO RELATED APPLICATION

The present application is the national stage under 35 U.S.C. 371 of PCT/SE98/01807, filed Oct. 7, 1998.

BACKGROUND OF THE INVENTION

Technical Field of the Invention

The present invention relates to a mast base.

More particularly, the invention relates to a mast base of the kind comprising a rigid body, intended to support a mast mounted thereon, and four supporting legs serving to support said body in a position in which it is elevated from a substrate for the mast base, said supporting legs extending laterally from the body in mutually diverging directions and being provided, at their outer ends, with supporting feet, by which they may rest on said substrate, each supporting leg comprising an upper arm which, at its inner end, is pivotally connected to an upper portion of the body for pivoting movement relatively to the body around a first horizontal pivot axis, and a lower arm, which, at its inner end, is pivotally connected to a lower portion of the body for pivoting movement relatively to the body around a second horizontal pivot axis, said two arms of each supporting leg being pivotally connected to each other at their outer ends for pivoting movement relatively to each other around a third horizontal axis and at least one of said two arms having a variable length.

Especially, if the mast base is intended to support an antenna mast having directional antennas affixed thereto, it is of outmost importance in a mast base of the above kind that it is possible to counteract any tendency to a variable rotation of the body of the mast base and the mast supported upon said body around a vertical axis that may be caused by wind load on the mast and the antennas affixed thereto. For this reason, in previously known mast bases of said kind, for instance in tha mast base disclosed in WO 93/17208, a plurality of stay wires have been mounted between the supporting feet of the supporting legs as well as between said feet and the lower portions of the body of the mast base. However, such an arrangement is unfavourable in several respects. Firstly, it implies that there do not occur any elements, sticking up from the substrate, that may obstruct a location of the various stay wires in their desired positions. Moreover, such an arrangement cannot be utilized at all to effectively prevent a rotation of the body of the mast base when the horizontal dimensions of said body are small in comparison with the length of the supporting legs.

OBJECT AND SUMMARY OF THE INVENTION

The invention therefore has for its purpose to provide an improved mast base of the kind initially specified, which offers a favourable solution of the problem above described.

The mast base, according to the invention proposed for said purpose, is primarily characterized in that the upper arm of each one of two supporting legs, which are located at mutually opposite sides of the body and which extend laterally from the body in mutually opposite directions, is pivotally connected to the body by means of two pivot joints, which are located spaced apart in the direction of the first horizontal pivot axis.

The invention eliminates the previous need for a plurality of stay wires, located at the lower end of the mast base, and makes it possible to hold the body firmly against any rotation thereof even in such cases, when the horizontal dimensions of the body are small in comparison with the length of the supporting legs.

According to a preferred embodiment of the invention, said two pivot joints between the body and the upper arm of each one of said two supporting legs may suitably be located at or near mutually different ones of two diagonally opposite corners of the body which, as seen in plan view, may have a generally square cross-sectional shape.

Furthermore, the upper arm of each one of said two supporting legs may preferably comprise two branches which extend in mutually converging directions towards the outer end of said arm from respective ones of said two pivot joints. Such a construction of said arm is especially favourable as a consequence of the fact that it will result in that the stiffness against lateral flexure of said arm will become very high.

In order to facilitate a location of the mast base upon a flat roof of a house or any other substrate, where various obstacles formed by elements sticking up from the substrate occur, at least one of the two other supporting legs, which are located at mutually opposite sides of the body of the mast base and the two firstmentioned supporting legs, may suitably be mounted for limited pivotal movement in a lateral direction around an at least approximately vertical pivot axis, located at the inner end of said leg.

Moreover, at its lower end, the body of the mast base may be provided with means serving to support a ballast. Such a design of the body eliminates the need for securing the feet of the supporting legs to the substrate or loading them with weights. As a consequence, the lower arms of the supporting legs will be subjected to tensile forces only, which means that said arms may be dimensioned substantially weaker than would be required if said arms are subjected also to compressive forces.

BRIEF DESCRIPTION OF THE DRAWINGS

Below the invention is further described with reference to the accompanying diagrammatic drawings, in which.

DETAILED DESCRIPTION OF THE PREFERRED EMBODIMENT OF THE INVENTION

Figure 1:
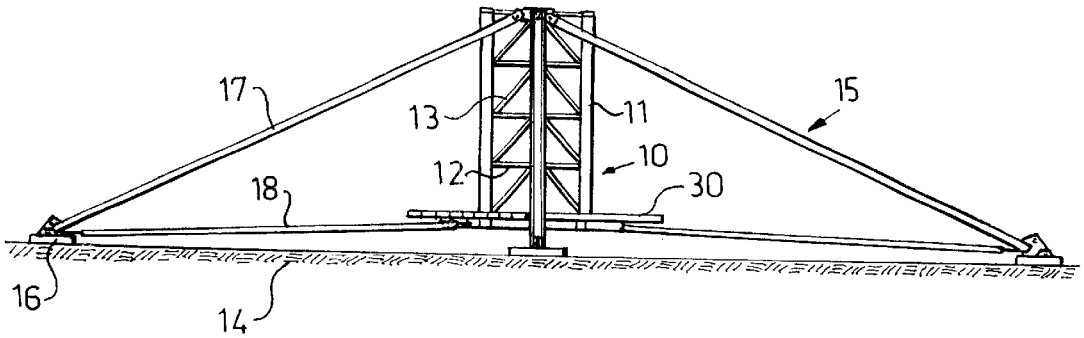
FIG. 1 shows a side elevation of a mast base according to an embodiment of the invention, selected by way of example only.
Figure 2:
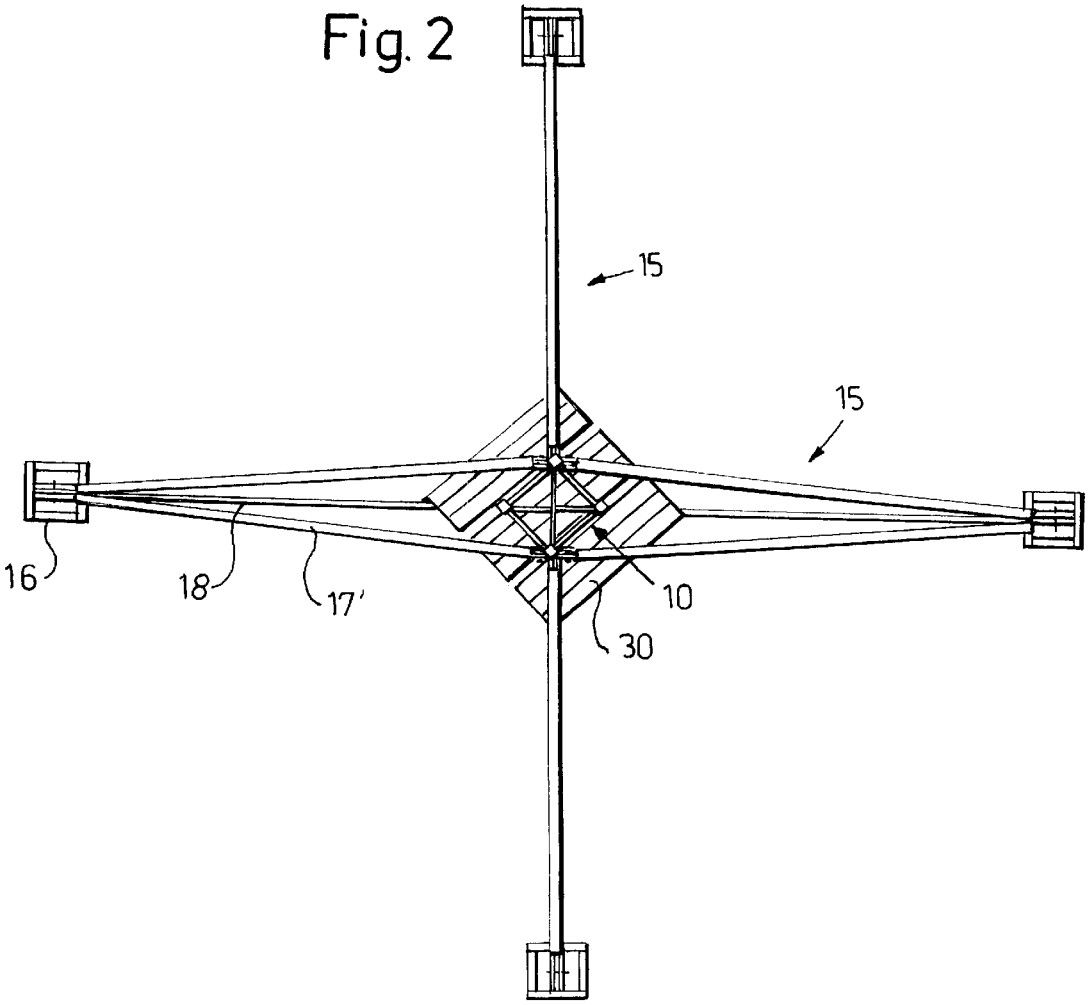
FIG. 2 shows a top plan view of the mast base according to FIG. 1.
Figure 3:
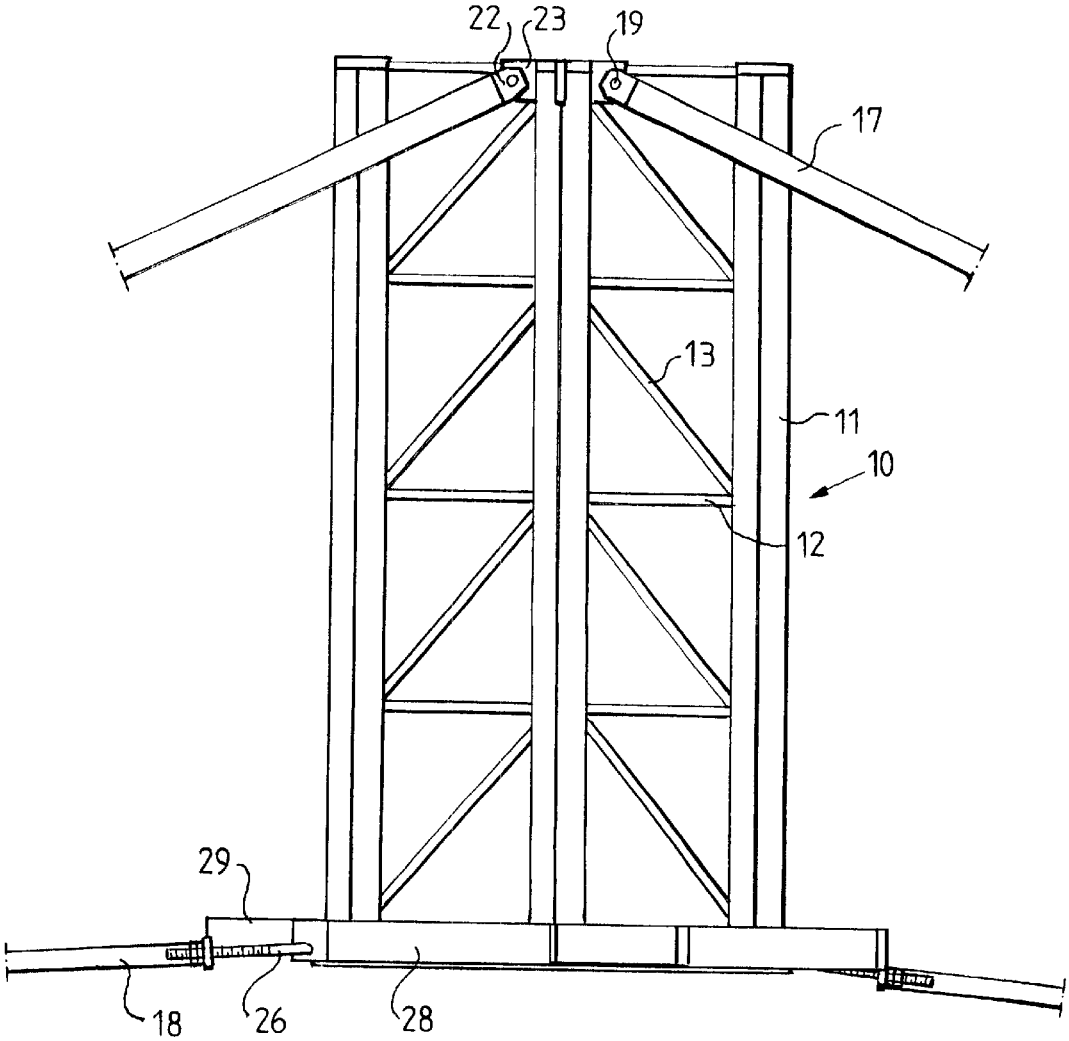
FIG. 3 shows a side elevation corresponding to FIG. 1 and on an enlarged scale of a rigid body of the mast base, illustrating also adjacent portions of two supporting legs projecting in mutually opposite lateral directions from said body.

The mast base shown in the drawings comprises a rigid body, generally designated 10 and formed as a vertically orientated frame work having a generally square cross-sectional shape, as seen in plan view, and comprising four longitudinally extending supporting members 11, located each in one corner thereof, and horizontal connection members 12 and inclined stiffening members 13, provided between said supporting members.

By means of four supporting legs, generally designated 15, body 10 is supported in a position elevated from a substrate 14 for the mast base which for instance may consist of a flat roof of a house. These supporting legs extend in mutually diverging directions from body 10 and, at their outer ends, they are provided with supporting feet 16 by means of which they rest on substrate 14.

Each supporting leg 15 consists of an upper arm 17, which in the illustrated case is assumed to have a fixed length and which at its inner end is pivotally connected to an upper portion of body 10 for pivoting movement relatively to said body around a first horizontal pivot axis $x_1$, and a lower arm 18 of variable length, which at its inner end is pivotally connected to a lower portion of body 10 for pivoting movement relatively to said body around a second horizontal pivot axis $x_2$. At their outer ends, the two arms 17 and 18 are pivotally connected to each other for pivoting movement relatively to each other around a third horizontal pivot axis $x_3$. Moreover, at its outer end, each supporting leg 15 is pivotally connected to the appurtenant supporting foot 16 in order to permit a pivoting movement thereof relatively to said foot around a forth horizontal pivot axis $x_4$.

As a consequence of the construction of supporting legs 15 above described and the pivotal connections between said legs and body 10 and supporting feet 16, it is possible, in a manner known per see, easily to adjust the supporting legs so as to bring them to support body 10 in a strictly vertical position.

Figure 4:
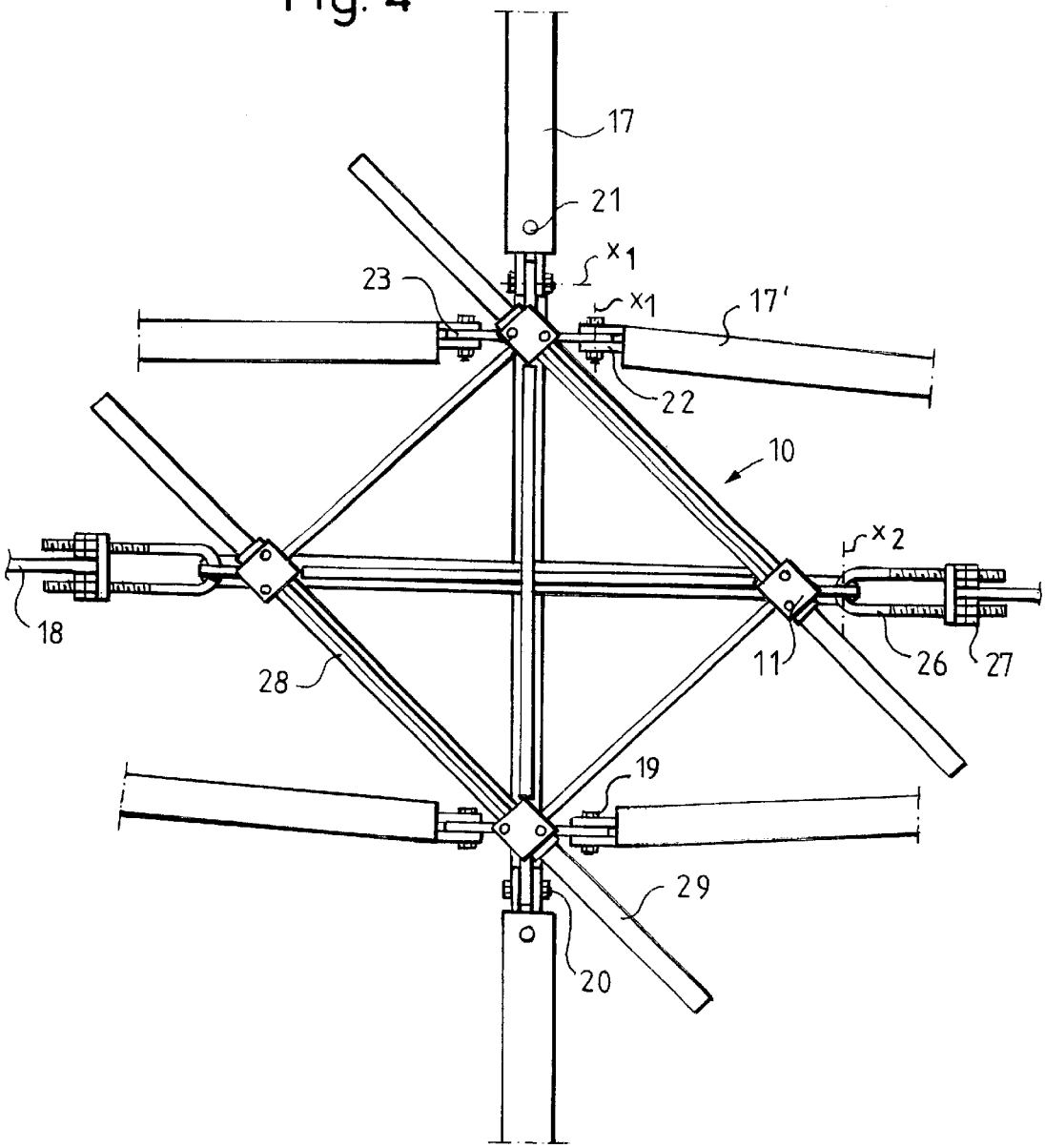
FIG. 4 shows a plan view on a still further enlarged scale of the body of the mast base, illustrating also adjacent portions of all four supporting legs connected to the body.
Figure 5:
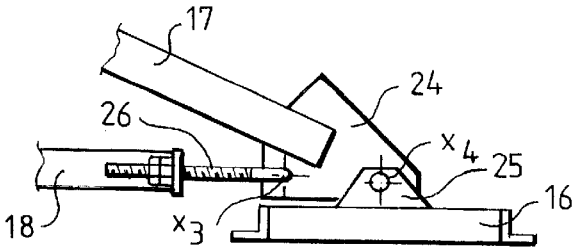
FIG. 5 shows a side elevation of a supporting foot mounted at the outer end of a supporting leg.

In order to fixate body 10 against any rotation thereof around its vertical longitudinal axis under the influence of outer torques applied thereon, two of the supporting legs 15 are constructed in a special manner. More particularly, the upper arm 17 of each one of said two supporting legs, which extend laterally from body 10 in mutually opposite directions, is formed by two branches 17' which are pivotally connected to body 10 by respective ones of two pivot joints 19 which are located spaced apart in the direction of the appurtenant first pivot axis $x_1$. From said pivot joints, the two branches 17' of arm 17 extend in mutually converging directions towards the outer end of said arm. As may best be seen from FIG. 4, the two pivot joints 19 between body 10 and the upper arm 17 of each one of said two supporting legs 15 are located at respective ones of two opposite corners of body 10.

Each one of the two other supporting legs 15, which are located at opposite sides of body 10 and the two supporting legs above mentioned, comprises an upper arm 17 which consists of a single branch and which is pivotally connected to body 10 for pivoting movement around the appurtenant pivot axis $x_1$ by means of a single pivot joint 20. At a short distance from pivot joint 20, the upper arm 17 of each one of said two other supporting legs 15 is provided with an additional pivot joint 21, which has for its purpose to facilitate a limited pivotal movement in a lateral direction of the supporting leg around an at least approximately vertical pivot axis.

The upper arms 17 of supporting legs 15 may suitably consist substantially of tubes having a square or rectangular cross-sectional shape which, at the inner ends of the supporting legs, are provided with two parallel bearing tongues 22 for pivotal connection to a mounting ear 23 provided at the body, while, at the outer ends of the supporting legs, they are provided with a connection plate 24 for pivotal connection to bearing plates 25 provided at the appurtenant supporting foot 16.

Also the lower arms 18 of supporting legs 15 may substantially consist of tubes of square or rectangular profile which, however, may have substantially smaller cross-sectional dimensions than the tubes of the upper legs and which, at their ends, may be provided with connection members consisting of U-bolts 26 having two threaded parallel legs on which nuts 27 are mounted to permit a variation of the effective length of arms 18. By means of bolts 26, arms 18 are pivotally connected each on the one hand to a mounting ear of body 10 and on the other hand to the connection plate 24 previously mentioned.

At the lower end of body 10, there are provided two horizontal hollow beams 28, located at opposite sides of said body, and hollow beams 29, constituting extensions of the firstmentioned beams and projecting in lateral directions from body 10. Beams 28 and 29 serve to support platform members 30 upon which a ballast may be placed. Provided that a ballast of sufficient size is placed upon members 30, it is possible to abstain from weight loading feet 16 of supporting legs 15. The lower arms 18 of the supporting legs will then be subjected to tensile forces only, which makes it possible to dimension these arms substantially weaker than the upper arms 17 which are subjected to compressive forces.

The invention is not restricted to the embodiment above described and shown in the drawings. Instead, many other embodiments are feasible within the scope of the invention as defined in the following claims.

What is claimed is:

1. Mast base, comprising a rigid body (10), intended to support a mast mounted thereon, and four supporting legs (15), serving to support said body in a position in which said body is elevated from a substrate (14) for the mast base, said supporting legs extending laterally from the body (10) in mutually diverging directions and being provided, at their outer ends, with supporting feet (16), by which they may rest on said substrate (14), each supporting leg (15) comprising an upper arm (17), which, at its inner end, is pivotally connected to an upper portion of the body (10) for pivoting movement relatively to the body around a first horizontal pivot axis ($x_1$), and a lower arm (18), which, at its inner end, is pivotally connected to a lower portion of the body (10) for pivoting movement relatively to the body around a second horizontal pivot axis ($x_2$), said two arms (17, 18) of said each supporting leg (15) being pivotally connected to each other at their outer ends for pivoting movement relatively to each other around a third horizontal axis ($x_3$) and at least one (18) of said two arms (17, 18) having a variable length, characterized in that the upper arm (17) of each one of the two supporting legs (15) of a first pair of such legs which are located at mutually opposite sides of the body (10) and which extend laterally from the body in mutually opposite directions, is pivotally connected directly to the body (10) by means of two separate pivot joints (19), which together define said horizontal pivot axis ($x_1$) and which are located at a substantial distance from each other as seen in the direction of said first horizontal axis ($x_1$);

wherein stay wires to counteract variable rotation of the body around a vertical axis of mast are eliminated.

2. Mast base according to claim 1, characterized in that said two pivot joints (19) between the body (10) and the upper arm (17) of each one of said two supporting legs (15) are located at or near mutually different ones of two diagonally opposite corners of the body (10) which, as seen in plain view, has a generally square cross-sectional shape.

3. Mast base according to claim 1, characterized in that the upper arm (17) of each one of said two supporting legs (15) comprises two branches (17') which extend in mutually converging directions towards the outer end of said arm (17) from respective ones of said two pivot joints (19).

4. Mast base according to claim 1, characterized in that at least one of the two other supporting legs (15), which are located at mutually opposite sides of the body (10) and said first pair of supporting legs (15), is mounted for limited pivotal movement in a lateral direction around an at least approximately vertical pivot axis (21) located at the inner end of said at least one leg.

5. Mast according to claim 1, characterized in that, at the lower end of the body (10), the body is provided with means (30) serving to support a ballast.

6. Mast base, comprising a rigid body (10), intended to support a mast mounted thereon, and four supporting legs (15), serving to support said body in a position in which said body is elevated from a substrate (14) for the mast base, said supporting legs extending laterally from the body (10) in mutually diverging directions and being provided, at their outer ends, with supporting feet (16), by which they may rest on said substrate (14), each supporting leg (15) comprising an upper arm (17), which, at its inner end, is pivotally connected to an upper portion of the body (10) for pivoting movement relatively to the body around a first horizontal pivot axis ($x_1$), and a lower arm (18), which, at its inner end, is pivotally connected to a lower portion of the body (10) for pivoting movement relatively to the body around a second horizontal pivot axis ($x_2$), said two arms (17, 18) of said each supporting leg (15) being pivotally connected to each other at their outer ends for pivoting movement relatively to each other around a third horizontal axis ($X_3$) and at least one (18) of said two arms (17, 18) having a variable length, characterized in that the upper arm (17) of each one of the two supporting legs (15) of a first pair of such legs which are located at mutually opposite sides of the body (10) and which extend laterally from the body in mutually opposite directions, is pivotally connected directly to the body (10) by means of two separate pivot joints (19), which together define said horizontal pivot axis ($x_1$) and which are located at a substantial distance from each other as seen in the direction of said first horizontal axis ($x_1$);

wherein said two pivot joints (19) between the body (10) and the upper arm (17) of each one of said two supporting legs (15) are located at or near mutually different ones of two diagonally opposite corners of the body (10) which, as seen in plain view, has a generally square cross-sectional shape;

wherein stay wires to counteract variable rotation of the body around a vertical axis of mast are eliminated.

7. Mast base, comprising a rigid body (10), intended to support a mast mounted thereon, and four supporting legs (15), serving to support said body in a position in which said body is elevated from a substrate (14) for the mast base, said supporting legs extending laterally from the body (10) in mutually diverging directions and being provided, at their outer ends, with supporting feet (16), by which they may rest on said substrate (14), each supporting leg (15) comprising an upper arm (17), which, at its inner end, is pivotally connected to an upper portion of the body (10) for pivoting movement relatively to the body around a first horizontal pivot axis ($x_1$), and a lower arm (18), which, at its inner end, is pivotally connected to a lower portion of the body (10) for pivoting movement relatively to the body around a second horizontal pivot axis ($x_2$), said two arms (17, 18) of said each supporting leg (15) being pivotally connected to each other at their outer ends for pivoting movement relatively to each other around a third horizontal axis ($x_3$) and at least one (18) of said two arms (17, 18) having a variable length, characterized in that the upper arm (17) of each one of the two supporting legs (15) of a first pair of such legs which are located at mutually opposite sides of the body (10) and which extend laterally from the body in mutually opposite directions, is pivotally connected directly to the body (10) by means of two separate pivot joints (19), which together define said horizontal pivot axis ($x_1$) and which are located at a substantial distance from each other as seen in the direction of said first horizontal axis ($x_1$);

wherein at least one of the two other supporting legs (15), which are located at mutually opposite sides of the body (10) and said first pair of supporting legs (15), is mounted for limited pivotal movement in a lateral direction around an at least approximately vertical pivot axis (21) located at the inner end of said at least one leg;

wherein stay wires to counteract variable rotation of the body around a vertical axis of mast are eliminated.

* * * * *